US008569603B2

(12) United States Patent
Parillo

(10) Patent No.: US 8,569,603 B2
(45) Date of Patent: Oct. 29, 2013

(54) TREMOLO STRUCTURE FOR STRINGED INSTRUMENT

(76) Inventor: Michael A. Parillo, North Brunswick, NJ (US)

( * ) Notice: Subject to any disclaimer, the term of this patent is extended or adjusted under 35 U.S.C. 154(b) by 0 days.

(21) Appl. No.: 12/971,313

(22) Filed: Dec. 17, 2010

(65) Prior Publication Data

US 2012/0152082 A1 Jun. 21, 2012

(51) Int. Cl.
*G10D 3/00* (2006.01)

(52) U.S. Cl.
USPC ..... 84/313

(58) Field of Classification Search
USPC ..... 84/313, 312 R
See application file for complete search history.

(56) References Cited

U.S. PATENT DOCUMENTS 5,986,192 A * 11/1999 Wingfield et al. ..... 84/313
7,183,475 B2 * 2/2007 Van Halen ..... 84/312 R

* cited by examiner

*Primary Examiner* — Jianchun Qin
(74) *Attorney, Agent, or Firm* — Dinicola & Young, PC; Brian K. Dinicola

(57) ABSTRACT

A tremolo device for use on a musical instrument having a neck extending between a body and head, and a plurality of strings under tension aligned with the neck includes a bridge structure resiliently supportable relative to the body for rotation about a pivot axis transverse to the neck. String retaining elements of the bridge structure are movable therewith, each being dimensioned and arranged to engage a corresponding string. An actuating lever extends rearwardly from a point of attachment to the bridge structure to a point further from the neck and pivot axis than the point of attachment. Lifting of the actuating lever by an upward force exerted by a strumming or plucking finger reduces tension in the strings and lowers the tone of the musical element and exertion of a downward force upon the actuating lever increases tension in the strings and increases the tone of the musical instrument.

11 Claims, 2 Drawing Sheets

TREMOLO STRUCTURE FOR STRINGED INSTRUMENT

BACKGROUND OF THE INVENTION

1. Field of the Invention

The present invention relates to stringed musical instruments such as electric guitars and, more particularly, to an improved tremolo arrangement for use with such instruments.

2. Discussion of the Prior Art

Guitarists frequently wish to create a musical effect known as "tremolo", the temporary altering of string pitch. Devices manipulable to produce this tremolo effect are described, for example, in U.S. Pat. Nos. 4,171,661, 4,555,970, and 4,882,967 to Rose and U.S. Pat. Nos. 2,741,146 and 2,972,923 to Fender. An electric guitar equipped with a tremolo apparatus constructed in accordance with the prior art is depicted in FIGS. 1 and 2. The guitar includes a sound body 1 from which extends a neck 2, terminating in a head 3. Strings 4 extend from a string bridge A that is mounted to sound body 1 so as to be rotatable about its longitudinal axis, this longitudinal axis extending transverse relative to the longituding axis of neck 2. At forward terminals 4*b*, strings 4 are wound around pegs 6. A lever bar indicated generally at 5 is attached to bridge A and extends from its point of attachment to bridge A in a direction generally toward head 3.

With particular reference to FIG. 2, it will seen that formed within body 1 is a transverse slot 12 which communicates at the under side of the body with a recess 13 directed toward neck 2. Bridge A includes a base plate 14, one margin of which is beveled to form a fulcrum ridge 15. The beveled margin of base plate 14 is secured to body 1 by screws (not shown) which permit limited pivotal movement of the base plate about the fulcrum 15. The fulcrum is located forwardly of the slot 12, that is, toward the neck 2. Secured to the inner side of the base plate 14 is a bar 25 which extends into slot 12. The bar is provided with a plurality of vertically extending bores (not shown). Each string 4 passes over a corresponding bridge element as bridge element 22*a*, through a slot (not shown) and into the corresponding bore in bar 25. Secured to the lower extremity of bar 25 is a plurality of tension springs 28 that extend forwardly within recess 13 and are relatively stiff. The forward extremeties of the tension springs are retained by hooks 29 formed along a margin of a tension plate 30. The tension plate 30 has a flange 31 at its forward margin which receives screws 32 adapted to be driven into the body 1 at the forward extremity of the recess 13. A cover plate 33 closes recess 13.

While strings 3 of the prior art system depicted in FIGS. 1 and 2 are touched, the handle of forward extending actuating lever 5 rides in the palm of the player's hand and the lever is pivoted by changing the position of the strumming/plucking hand—pivoting bridge A away from or nearer to body 1 and thereby increasing or decreasing the tension in strings 3 to obtain the desired tremolo effect. As used herein, the term "forward extending" refers to a tremolo actuating lever which extends from its point of attachment to the bridge in a direction generally toward the neck and head (proximal end) of the instrument, as opposed to a distal end of the instrument.

A disadvantage arises in that the large, forward extending lever 5 used to apply pivoting forces to the bar or plate requires awkward, unnatural movements to use. Lever 5 tends to swing around when the instrument is played and is rarely in the same place when the player has to reach for it. This can cause problems during a performance. Finally, a long reach to grab onto the bar takes the plucking or strumming hand away from the strings, which can affect the timing of the music being played A need therefore exists for a tremolo actuating arrangement that allows the user to obtain the tremolo effect with minimal effort, and in a repeatable manner, using the strumming hand.

A further need exists for an actuating structure that can be easily retrofitted to styles of stringed instruments which are already designed to accommodate a conventional tremolo structure such, for example, as tremolo-equipped Fender, Paul Reed Smith, or Floyd Rose Tremolo system-equipped electric guitar models.

SUMMARY OF THE INVENTION

The aforementioned needs are addressed, and an advancement is made in the art, by a tremolo device in which the actuating lever that is manipulable by the performer to achieve a tremolo effect extends rearwardly from its point of attachment or connection to the string bridge. The result is a tremolo actuating lever or bar that can be easily and pulled upward with the fingers of the strumming hand to produce the desired effect.

An illustrative embodiment of the invention incorporates a short actuating lever having one or more arcuate "notches" or recesses defined in its outer surface, the notches being proximate a first end of the lever and being dimensioned and arranged to receive corresponding fingers of the plucking or strumming hand. Alternative embodiments may incorporate small loops or a hook dimensioned and arranged to receive and/or support the finger(s) of the plucking or strumming hand.

In accordance with one embodiment of the present invention, the actuating lever is a separately formed structure affixed to a pivotably movable bridge structure by mechanical means such, for example, as a screw insertable into respective bores in the lever and bridge, or threadably engaged with a threaded bore defined in the bridge, or a bolt extending through an unthreaded bore and secured by a threaded nut. Alternatively, the actuating lever may have a threaded end suitably dimensioned for insertion and threaded engagement with a threaded bore defined in the bridge structure.

A musical instrument constructed in accordance with an illustrative embodiment of the present invention comprises a body, a head, a neck extending therebetween to define a longitudinal axis, a plurality of strings under tension aligned with the neck, and a bridge structure resiliently supported relative to the body for rotation about a pivot axis transverse to the longitudinal axis. The bridge structure includes a plurality of string retaining elements each dimensioned and arranged to engage a corresponding one of the plurality of strings wherein pivoting of the bridge structure in a first direction relative to the body increases tension in the strings and pivoting of the bridge structure in a second direction relative to the body decreases tension in said strings whereby on vibration of the strings a tremolo effect is produced An actuating lever is attached to the bridge structure and is movable therewith. In contrast to prior art tremolo devices, however, the actuating lever extending rearwardly—i.e., away from a point of attachment to the bridge structure and toward a point further away from the neck and pivot axis than the point of attachment. Accordingly, exertion of an upward force upon the actuating lever by a finger of the strumming/plucking hand causes pivoting of the bridge structure away from the instrument body, reducing the tension in the strings and lowering the tone of the musical instrument. In a similar manner, exertion of a downward force upon the actuating lever increases tension in the strings and increases the tone of the musical instrument.

A stringed instrument such as an electric guitar already equipped with a conventional tremolo device may be easily adapted to make use of the novel actuating system of the present invention by attaching an actuating lever at a point of attachment on the bridge structure so that it extends rearwardly therefrom, i.e., away from the neck and pivot axis of the bridge structure. The compact structure of the solid mounted actuating lever of the present invention, which may be on the order of two to four inches in length, can be easily retrofitted onto such instruments to provide an advantage when using subtle musical nuances, such as harmonic notes with tremolo effect, where the performer wants to effect only the slightest movement of the bridge structure. The conventional, forward facing actuating lever may also be provided, giving the performer adding flexibility and options depending upon preference.

BRIEF DESCRIPTION OF THE DRAWINGS

The aspects of the present invention will become more apparent by describing in detail illustrative, non-limiting embodiments thereof with reference to the accompanying drawings, in which like reference numerals refer to like elements in the drawings.

DETAILED DESCRIPTION

The teachings set forth herein are directed generally to the incorporation of a rearwardly extending actuating lever so that the tension in the strings of, and tone produced by, a stringed instrument such as an electric guitar to be decreased by upward lifting forces exerted by the finger(s) of a strumming/plucking hand (and increased by exerting downward forces). It will therefore be readily apparent to those skilled in the art that the teachings of the present invention may be applied to any stringed instrument which utilizes a pivoting member or structure to create the variations in string tension needed to develop a tremolo effect. Thus, by way of illustration, an actuating lever constructed in accordance with the present invention may be readily adapted to the tremolo structure disclosed in U.S. Pat. No. 2,741,146 issued Apr. 10, 1956 to Fender, which patent, as well as any of the tremolo structures disclosed in U.S. Pat. Nos. 4,939,971 (Satoh), 4,823,669 (Sarricola), 5,419,227 (Lavineway), 4,383,466 (Shibuya), 4,882,967 (Rose) and 5,747,713 (Clement), are expressly incorporated herein by reference.

Figure 1:
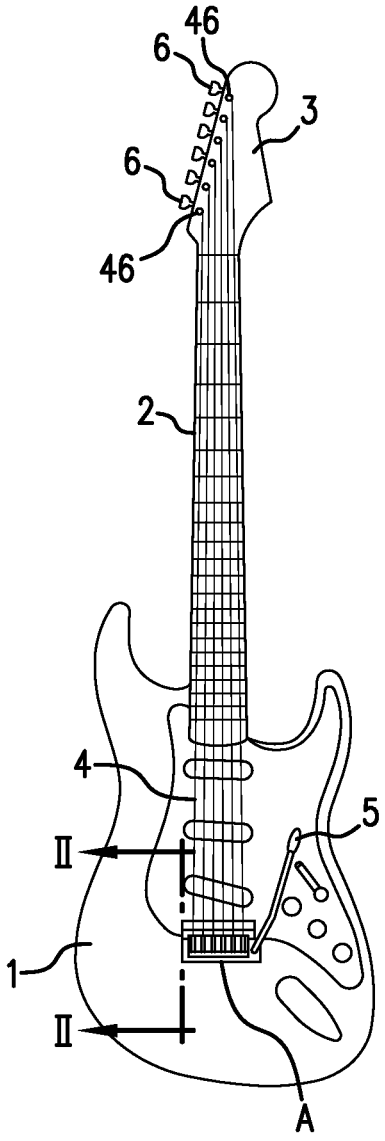
FIG. 1 (PRIOR ART)
FIG. 1 is a front elevation view of an electrical guitar incorporating a prior art tremolo device as disclosed in U.S. Pat. No. 2,741,146, which is incorporated herein in its entirety.
Figure 2:
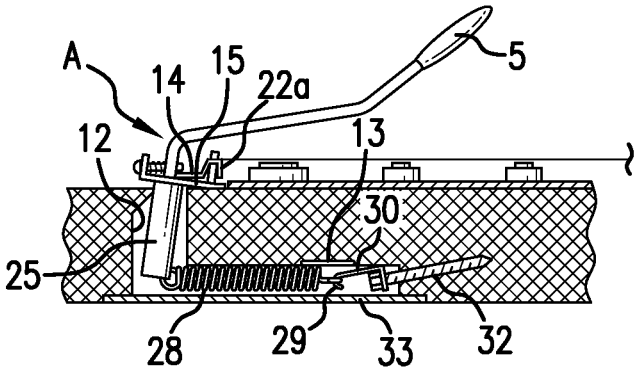
FIG. 2 (PRIOR ART)
FIG. 2 is a cross sectional view depicting in greater detail the construction of the prior art tremolo bridge of FIG. 1.
Figure 3:
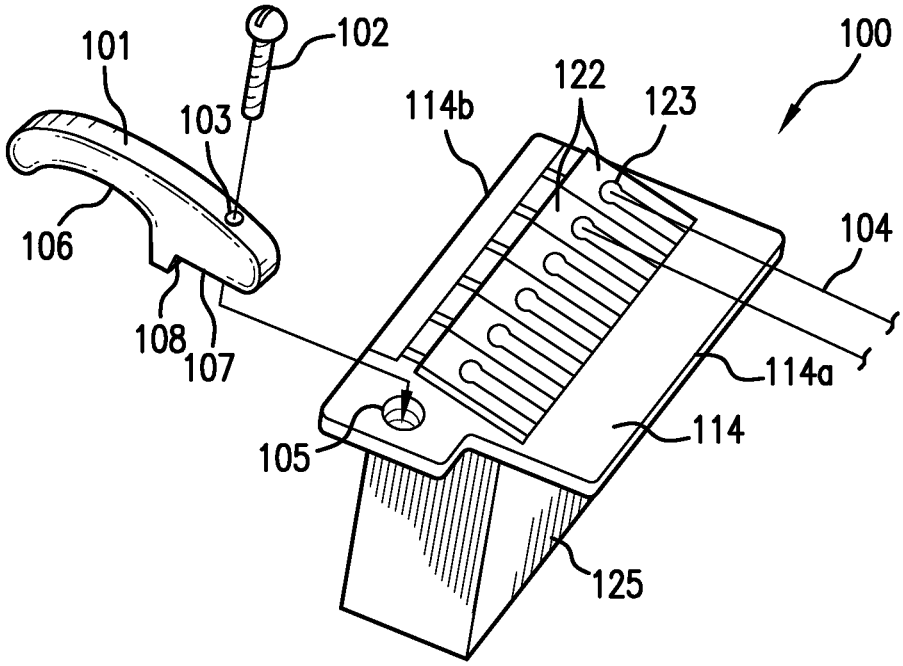
FIG. 3 is a partial, exploded perspective view depicting an illustrative embodiment of a tremolo assembly that incorporates a rearwardly extending actuating lever in accordance with the teachings of the present invention.

In any event and turning now to the illustrative embodiment depicted in FIG. 3, it will be seen that an illustrative bridge structure indicated generally at reference numeral 100 includes an upper plate 114 having a forward edge 114*a*—which defines an axis of rotation transverse to a longitudinal axis defined by the neck and strings—and a rear edge 114. Positioned on upper plate 114 is a plurality of string retaining elements 122 dimensioned and arranged to receive ends of strings 104 and maintain them in a state of tension. The basic configuration of bridge structure in the illustrative embodiment of FIG. 3 is essentially identical to that disclosed in the aforementioned U.S. Pat. No. 2,741,146, as also depicted in FIG. 2. Secured to the inner side of the base plate 114 is a bar 125 which extends into a slot (not shown) formed in the body of the instrument. The bar is provided with a plurality of vertically extending bores (not shown). Each string 104 passes over a corresponding bridge element as bridge element 122, through a slot (not shown) and into the corresponding bore 123 in bar 125. Secured to the lower extremity of bar 125 is a plurality of tension springs (not shown) that extend forwardly within a recess formed in the body.

Figure 4:
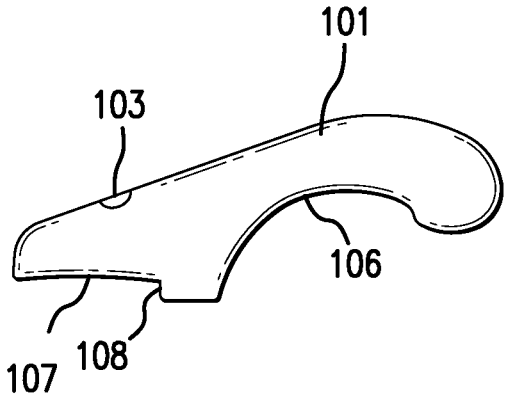
FIG. 4 is an exploded perspective view depicting in greater detail an actuating lever constructed in accordance with an illustrative embodiment of the present invention.

A bore 105 defined in upper plate 114 is dimensioned and arranged to receive a threaded fastener 102 inserted through a bore 103 defined in actuating lever 101. The assembly may be secured using a threaded nut (not shown), or by threading the interiors of bores 103 and 105, or by utilizing self-tapping screws, by way of example. Alternatively, bore 103 may be omitted and lever 101 may be configured with a threaded extension dimensioned and arranged for insertion into bore 105. It suffices to say that the manner in which actuating lever is secured, attached, affixed or otherwise provided on bridge structure 100 is deemed to be a matter of design choice left to the artisan of ordinary skill Turning now to FIG. 4, it will be seen that lever 101 defines an arcuately contoured recess or depression dimensioned and arranged to receive one or more finger(s) of a performer's strumming or plucking hand. The overall length of lever 101 may be on the order of 2 to 4 inches, or slight longer if desired. Lever 101 further includes an abutment 108 and a joining surface 107 which are pressed into engagement with rear surface 114*b* and an upper surface region of upper plate 114, respectively, prior to final assembly using fastener 102. In contrast with the prior art, actuating lever 101 extends rearwardly from its point of attachment with upper plate 114 so that lifting/downward forces are imparted behind the axis around which the bridge structure is pivoted. This advantageously gives the performer a greater level of control and considerably more freedom of movement than may be achieved using a conventional structure.

It is believed that other modifications, variations and changes will be suggested to those skilled in the art in view of the teachings set forth herein. It is therefore to be understood that all such variations, modifications and changes are believed to fall within the scope of the present invention. Although specific terms are employed herein, they are used in their ordinary and accustomed manner only, unless expressly defined differently herein, and not for purposes of limitation.

What is claimed is:

1. A tremolo device for use on a musical instrument having a body, a head, and a neck extending therebetween to define a longitudinal axis, and a plurality of strings under tension aligned with the neck, said device comprising:

a bridge structure resiliently supportable relative to the body for rotation about a pivot axis transverse to the longitudinal axis;

a plurality of string retaining elements positioned on said bridge structure and movable therewith, each respective string retaining element being dimensioned and arranged to engage a corresponding one of said plurality of strings wherein pivoting of said bridge structure in a first direction relative to the body increases tension in said strings and pivoting of said bridge structure in a second direction relative to the body decreases tension in said strings whereby on vibration of said strings a tremolo effect is produced; and an actuating lever attached to said bridge structure and movable therewith, said actuating lever extending rearwardly from a point of attachment to said bridge structure to a point further away from the neck and pivot axis than the point of attachment, wherein said actuating lever defines a joining surface and an abutment engageable with a rear edge surface of the bridge structure, said abutment and joining surface being dimensioned and arranged to maintain the actuating lever in a fixed rearwardly extending position relative to the bridge structure.

2. The tremolo device of claim 1, wherein said actuating lever further defines a contoured surface region dimensioned and arranged for engagement with at least one of the fingers a performer's hand during strumming or plucking, whereby lifting of the actuating lever by a finger exerting an upward force upon said contoured surface region reduces tension in the strings and lowers the tone of the musical instrument and whereby exertion of a downward force upon the actuating lever increases tension in the strings and increases the tone of the musical instrument.

3. The tremolo device of claim 1, wherein said actuating lever is attached to the bridge structure by a mechanical fastener.

4. The tremolo device of claim 3, wherein the actuating lever defines a bore, wherein the bridge structure defines a threaded bore, and wherein the mechanical fastener is a threaded fastener dimensioned and arranged for insertion through the actuating lever and into the threaded bore to thereby retain the abutment and the joining surface against surfaces of the bridge structure.

5. A musical instrument comprising a body, a head, a neck extending therebetween to define a longitudinal axis, a plurality of strings under tension aligned with the neck, and a bridge structure resiliently supported relative to the body for rotation about a pivot axis transverse to the longitudinal axis, the bridge structure including a plurality of string retaining elements each dimensioned and arranged to engage a corresponding one of the plurality of strings wherein pivoting of the bridge structure in a first direction relative to the body increases tension in the strings and pivoting of the bridge structure in a second direction relative to the body decreases tension in said strings whereby on vibration of the strings a tremolo effect is produced, and wherein the improvement comprises:

an actuating lever attached to the bridge structure and movable therewith, said actuating lever extending rearwardly from a point of attachment to said bridge structure to a point further away from the neck and pivot axis than the point of attachment, wherein said actuating lever defines a joining surface and a protruding abutment engageable with a surface of the bridge structure, said abutment and joining surface being dimensioned and arranged to maintain the actuating lever in a fixed rearwardly extending position relative to the bridge structure.

6. The musical instrument of claim 5, wherein said actuating lever further defines a contoured surface region dimensioned and arranged for engagement with at least one of the fingers a performer's hand during strumming or plucking, whereby lifting of the actuating lever by a finger exerting an upward force upon said contoured surface region reduces tension in the strings and lowers the tone of the musical instrument and whereby exertion of a downward force upon the actuating lever increases tension in the strings and increases the tone of the musical instrument.

7. The musical instrument of claim 5, wherein said actuating lever is attached to the bridge structure by a mechanical fastener.

8. The tremolo device of claim 7, wherein the actuating lever defines a bore, wherein the bridge structure defines a threaded bore, and wherein the mechanical fastener is a threaded fastener dimensioned and arranged for insertion through the actuating lever and into the threaded bore to thereby retain the abutment and the joining surface against surfaces of the bridge structure.

9. A method comprising:

providing a musical instrument comprising a body, a head, a neck extending therebetween to define a longitudinal axis, a plurality of strings under tension aligned with the neck, and a bridge structure resiliently supported relative to the body for rotation about a pivot axis transverse to the longitudinal axis, the bridge structure including a plurality of string retaining elements each dimensioned and arranged to engage a corresponding one of the plurality of strings wherein pivoting of the bridge structure in a first direction relative to the body increases tension in the strings and pivoting of the bridge structure in a second direction relative to the body decreases tension in said strings whereby on vibration of the strings a tremolo effect is produced; and actuating lever attached to the bridge structure and movable therewith, said actuating lever extending rearwardly from a point of attachment to said bridge structure to a point further away from the neck and pivot axis than the point of attachment; and attaching an actuating lever to the bridge structure for movement therewith, the actuating lever extending rearwardly from a point of attachment to the bridge structure to a point further away from the neck and pivot axis than the point of attachment, wherein said actuating lever defines a joining surface and a protruding abutment engageable with a surface of the bridge structure, said abutment and the joining surface being dimensioned and arranged to maintain the actuating lever in a fixed rearwardly extending position relative to the bridge structure.

10. The method of claim 9, wherein said step of attaching is performed by inserting a threaded fastener into a bore defined by the actuating lever and a threaded bore defined by the bridge structure, and tightening the threaded fastener within the second bore to thereby retain the abutment and the joining surface in fixed engagement with the bridge structure.

11. The method of claim 9, wherein the actuating lever further defines a contoured surface region dimensioned and arranged for engagement with at least one of the fingers a performer's hand during strumming or plucking, whereby lifting of the actuating lever by a finger exerting an upward force upon said contoured surface region reduces tension in the strings and lowers the tone of the musical instrument and whereby exertion of a downward force upon the actuating lever increases tension in the strings and increases the tone of the musical instrument.

* * * * *